United States Patent [19]

Chase

[11] Patent Number: 5,030,145

[45] Date of Patent: Jul. 9, 1991

[54] MANUALLY OPERABLE BOAT PROPELLER

[76] Inventor: Robert Chase, R.D. #1, Bulger, Pa. 15019

[21] Appl. No.: 551,070

[22] Filed: Jul. 11, 1990

[51] Int. Cl.[5] ..... B63H 16/20

[52] U.S. Cl. ..... 440/26; 440/53

[58] Field of Search ..... 440/21, 25, 26, 27, 440/28, 29, 31, 32, 53; 114/144 R

[56] References Cited

U.S. PATENT DOCUMENTS

| | | | |
|---|---|---|---|
| 1,512,902 | 10/1924 | Boyd | 440/31 |
| 1,917,503 | 7/1933 | Crump | 440/31 |
| 2,487,195 | 11/1949 | Stephens | 440/31 |
| 2,627,243 | 2/1953 | Stahmer | 440/31 |
| 2,684,045 | 7/1954 | Cato | 440/31 |
| 2,835,217 | 5/1958 | Newberry | 440/26 |
| 3,323,482 | 6/1967 | Sanborn | 440/31 |

*Primary Examiner*—Sherman Basinger
*Assistant Examiner*—Stephen P. Avila
*Attorney, Agent, or Firm*—William J. Ruano

[57] ABSTRACT

A manually operable unit having a single handle for driving, steering and tilting a boat propeller. The crank handle, when turned, drives the propeller through bevel gearing. A vertical sleeve surrounding a vertical drive shaft has an offset U-shaped portion terminating in a sleeve serving as a bearing for the crank handle. Pushing the crank handle against the bearing rotates the vertical sleeve which mounts the propeller, therefore steering the propeller. Pulling of the handle will tilt the vertical sleeve with respect to a mounting C-clamp to pivotally raise the propeller.

1 Claim, 1 Drawing Sheet

MANUALLY OPERABLE BOAT PROPELLER

This invention relates to a boat propeller that is manually operable.

BACKGROUND OF THE INVENTION

Frequently, motor operated boats become disabled, either from running out of gas or from mechanical failure. Under such situation, complete control of the boat travel and steering is lost, allowing the boat to drift along with the stream, which can be very perilous if falls occur downstream.

SUMMARY OF THE INVENTION

An object of the present invention is to overcome the above mentioned perils of disabled motor boats by providing an emergency unit having a manually operable boat propeller that has three functions, namely it manually drives the propeller as well as steer it and tilt it out of the water by the same manual handle.

DESCRIPTION OF THE PREFERRED EMBODIMENT

Figure 1:
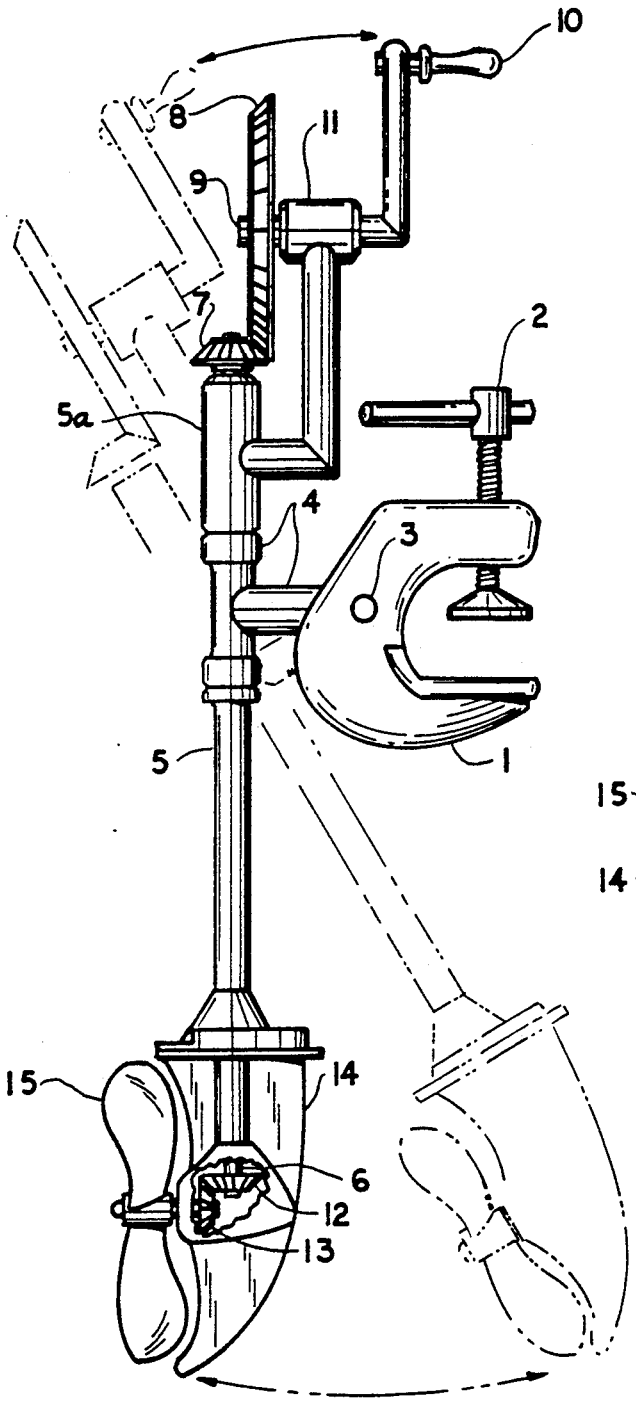
FIG. 1 is an elevational view of the manually operable boat propeller of the invention.
Figure 2:
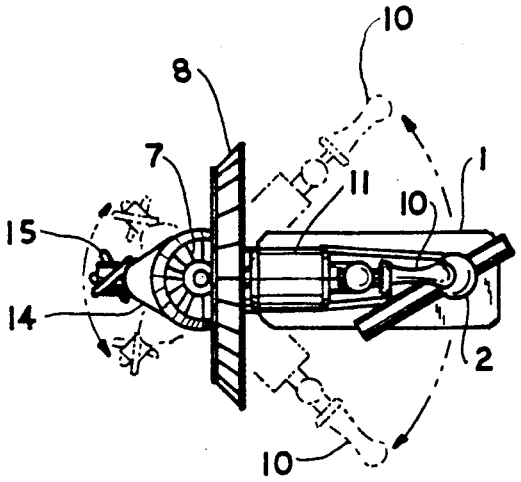
FIG. 2 is a top view thereof.

Referring to FIGS. 1 and 2, numeral 1 denotes a C clamp having a screw threaded portion 2 for clamping the assembly to a horizontal portion of the rear of the boat (not shown). When clamped onto the boat, the clamp becomes a stationary part of the assembly on which a T shaped sleeve bearing 4 is pivotally mounted by a bolt 3 so as to enable the entire assembly to tilt to the position shown in dot and dash lines to remove the propeller from the water or to tilt it.

Normally, the T shaped sleeve bearing serves as a stationary vertical bearing mounting on which sleeve 5, 5*a* is rotatable and in which drive shaft 6 is rotatably mounted extending throughout the entire height of sleeve 5; 5*a*.

The top end of drive shaft 6 is rigidly connected to pinion 7 which is driven by gear 8 connected to shaft 9 turned by crank handle 10 in a U-shaped sleeve 11 integrally connected to sleeve 5*a* which serves as a bearing for turning of crank handle 10.

The bottom end of drive shaft 6 drives a pinion gear 12, 13, in housing 14 rigidly connected to sleeve 5, so as to drive the propeller 15.

In order to steer the boat within the limits shown in dash and dot lines in FIG. 2, the handle 9 is turned in an arcuate path about the axis of shaft 6 as a center which will steer the propeller within the limits shown in dash and dot lines in FIG. 2.

Although the invention has been described as an emergency unit, it may be the only unit necessary for a fisherman that desires merely to go out away from the shore to find a desirable spot for fishing.

While I have illustrated and described a single specific embodiment of my invention, it will be understood that this is by way of illustration only and that various changes and modifications may be contemplated in my invention within the scope of the following claims.

I claim:

1. A manually operable unit for driving, steering and tilting a boat propeller by a single handle, comprising clamp means for clamping the unit to the rear of the boat, a vertically extending drive shaft including bevel gear means at both ends, a sleeve bearing in which said shaft is mounted, an arm having one end connected to said sleeve bearing to form a T-shaped structure, a pivotal bolt connecting the other end of said arm to said clamp means to effect tilting of said T-shaped structure and unit to pivotally raise and lower the bottom of said unit, a sleeve coaxial with and rotatable relative to said sleeve bearing including a laterally offset portion which includes a bearing, a crank handle geared to the uppermost of said gear means on said vertically extending shaft and rotatably mounted in said last mentioned bearing, a propeller housing rigidly enclosing the bottom of said drive shaft, a propeller geared to the lowermost of said bevel gear means, whereby pushing of said handle against said last mentioned bearing about the drive shaft axis will effect rotation of said last mentioned sleeve about its axis through a portion of a circle to effect steering of said propeller, whereby different movements of said crank handle will selectively effect tilting, steering and rotational movement of said propeller.

* * * * *